US005097816A

United States Patent [19]

Miller

[11] Patent Number: 5,097,816

[45] Date of Patent: Mar. 24, 1992

[54] PROJECTILE CONTAINER FOR USE WITH A DEVICE THAT SELECTIVELY DISCHARGES FRAGILE PROJECTILES, SUCH AS PAINTBALLS, UNDER THE INFLUENCE OF A SOURCE OF FLUID PRESSURE

[76] Inventor: John D. Miller, 1475-D Mount Hope Rd., Fairfield, Pa. 17320

[21] Appl. No.: 570,532

[22] Filed: Aug. 21, 1990

[51] Int. Cl.[5] ..... F41A 9/61; B65G 11/06

[52] U.S. Cl. ..... 124/49; 124/41.1; 221/75; 193/12; 193/32

[58] Field of Search ..... 124/49, 50, 45, 41.1, 124/48, 53, 52, 72, 51.1; 193/12, 32, 40; 198/772; 221/75

[56] References Cited

U.S. PATENT DOCUMENTS

| | | | |
|---|---|---|---|
| 3,095,074 | 6/1963 | Neidhardt | 193/40 |
| 3,187,872 | 6/1965 | Hill et al. | 193/32 X |
| 3,584,614 | 6/1971 | Horvath | 124/50 X |
| 3,715,055 | 2/1973 | Kendrick et al. | 221/75 |
| 4,004,566 | 1/1977 | Fischer . | |
| 4,038,961 | 8/1977 | Olofsson . | |
| 4,185,608 | 1/1980 | Young et al. | 124/49 X |
| 4,209,003 | 6/1980 | Sainsbury | 124/41.1 X |
| 4,227,508 | 10/1980 | D'Andrade | 124/49 X |
| 4,237,851 | 12/1980 | Haller | 124/41.1 X |
| 4,560,086 | 12/1985 | Stol | 221/75 X |
| 4,741,537 | 5/1988 | Adam | 124/50 X |
| 4,819,609 | 4/1989 | Tippmann . | |

*Primary Examiner*—Peter M. Cuomo
*Attorney, Agent, or Firm*—Terry M. Gernstein

[57] ABSTRACT

A container is adapted to be mounted on a paintball weapon to feed paintballs into the firing chamber of such weapon under the influence of gravity. The container includes a hollow housing in which a monolithic, one-piece helical ramp is located. The paintballs are fed onto the helical ramp and move under the influence of gravity from an inlet section to an outlet section for feeding the paintballs to the weapon. Elements located in the helical path defined by the helical ramp prevent the paintballs from moving backwards.

12 Claims, 4 Drawing Sheets

PROJECTILE CONTAINER FOR USE WITH A DEVICE THAT SELECTIVELY DISCHARGES FRAGILE PROJECTILES, SUCH AS PAINTBALLS, UNDER THE INFLUENCE OF A SOURCE OF FLUID PRESSURE

TECHNICAL FIELD OF THE INVENTION

The present invention relates to the general art of amusement devices, and to the particular field of compressed gas powered weapons which fire fragile projectiles such as marking pellets and paintball projectiles.

BACKGROUND OF THE INVENTION

Simulated combat, similar in nature to war games performed by the armed forces, has become one of the most rapidly growing leisure time activities of recent times. From about 1981, at its inception, such activity has grown to more than five hundred thousand participants today. the sport has grown to the point of being organized into teams, associations and the like. It has also been noted that paintball is one of the fastest growing outdoor sports in the country, and is currently played in over twelve different countries.

The participants in such games, also known as paint ball, use pressure-operated weapons to fire gelatin-coated projectiles containing a water-soluble dye at each other. Upon impact, the projectile marks the target with the dye. The combat can include maneuvers, captures and the like, and this sport has generated a plethora of equipment-related elements, including helmets, vests, visors and the like.

The weapons used in paint ball, have been the focus of development as well, and generally include a source of pressurized gas, such as carbon dioxide, which is controlled by a pump-action element, and the projectiles are fed into a firing chamber for firing from a container.

Heretofore, the ammunition, that is, the pant balls, has been stored in boxes that can be mounted on the weapon. However, such ammunition storage containers have several drawbacks which tend to detract from the full enjoyment of the activity.

For example, in such containers, the paint balls have tended to jam as these balls enter the firing chamber. Such jamming can result in simply a blast of gas (sans projectile) or a slicing of the paint ball in the firing chamber.

Additionally, as the container empties, the remaining paint balls have had a tendency to rattle about thereby giving a player away.

The inventor has observed that the paintballs will not jam when the container is fully loaded. All present ammunition boxes do have a tendency to jam. Secondly, it is noted that the ammunition box should have a capability of storing a large number of paintballs.

Therefore, there is a need for a projectile container for use with a weapon which selectively discharges projectiles under the influence of fluid pressure which is not likely to cause the weapon to jam in use, does not have a tendency to rattle when partially empty, and has a capability of storing a large number of projectiles, yet can still be inexpensive to manufacture. Specifically, there is a need for such a container which can be used in conjunction with a paint ball weapon.

OBJECTS OF THE INVENTION

It is a main object of the present invention is to provide a projectile container for use with a weapon which selectively discharges projectiles under the influence of fluid pressure which is not likely to cause the weapon to jam in use.

It is another object of the present invention to provide a projectile container for use with a weapon which selectively discharges projectiles under the influence of fluid pressure which is not likely to cause the weapon to jam in use and does not have a tendency to rattle when partially empty.

It is another object of the present invention to provide a projectile container for use with a weapon which selectively discharges projectiles under the influence of fluid pressure which is not likely to cause the weapon to jam in use, does not have a tendency to rattle when partially empty, and has a capability of storing a large number of projectiles.

It is a specific object of the present invention to provide a projectile container for use with a paint ball weapon which selectively discharges paint ball projectiles under the influence of fluid pressure which is not likely to cause the weapon to jam in use, does not have a tendency to rattle when partially empty, and has a capability of storing a large number of projectiles.

It is another specific object of the present invention to provide a projectile container for use with a paint ball weapon which selectively discharges paint ball projectiles under the influence of fluid pressure which is not likely to cause the weapon to jam in use, does not have a tendency to rattle when partially empty, and has a capability of storing a large number of projectiles, yet can be inexpensive to manufacture and to sell.

SUMMARY OF THE INVENTION

These, and other, objects are achieved by a projectile container which includes a hollow housing and a one-piece, monolithic helical ramp located therein. Projectiles are placed into the container and onto the ramp, and are fed to a weapons's firing chamber under the influence of gravity. The helical ramp includes, in one embodiment, elements which prevent the paintballs from moving in a direction opposite to the feed direction whereby rattling can be prevented. One form of the reverse movement prevention means includes a multiplicity of resilient curved elements attached to the container adjacent to the ramp, and another form of this reverse movement preventing means includes spring-biased ramp elements as well as which prevent the projectiles in the helical body from moving away from the firing chamber. These ramp elements prevent rattling of the projectiles.

In this manner, the projectiles in the container are not likely to jam or rattle s as the number of projectiles becomes depleted.

The helical ramp element is a one-piece monolithic element and thus is easy and inexpensive to manufacture and is not likely to rattle during use.

BRIEF DESCRIPTION OF THE DRAWING FIGURES

DETAILED DESCRIPTION OF THE PREFERRED EMBODIMENT OF THE INVENTION

Figure 1:
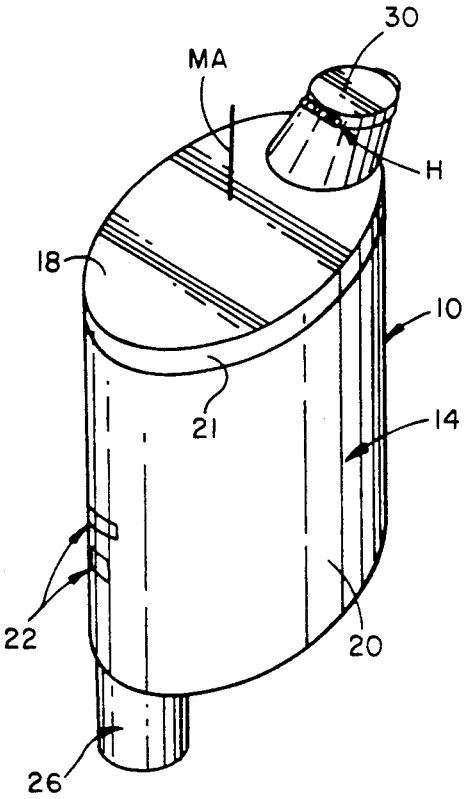
FIG. 1 is a perspective of the paintball container of the present invention.
Figure 2:
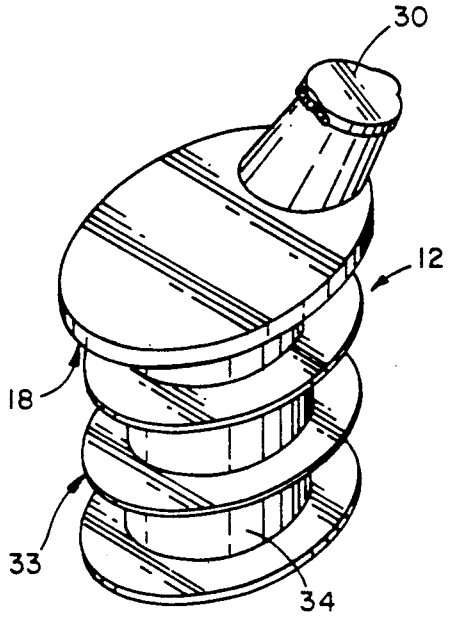
FIG. 2 is a perspective of the monolithic, one-piece helical ramp element of the present invention.
Figure 3:
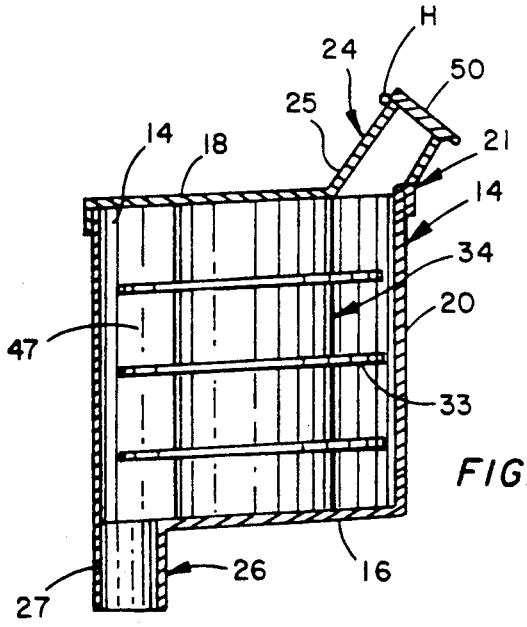
FIG. 3 is cut away side elevational view of the container having the helical ramp element positioned therein.

As above discussed, many paintball projectile containers used prior to the present invention have had certain problems and drawbacks. The present invention is shown in FIGS. 1, 2 and 3, and is embodied in a container 10 that includes a one-piece, monolithic helical ramp section 12 in a hollow housing 14 and which is attached to a paintball firing weapon to feed the projectiles into a firing chamber of that weapon under the influence of gravity. The helical ramp section is releasably attached to the housing at a plurality of locations in a manner which will securely lock that ramp section to the housing, but will permit removal of the ramp section if necessary. One form of lock is a snap lock having a projecting arcuate head releasably received in a dimple in the manner of a clothes snap.

Figure 4:
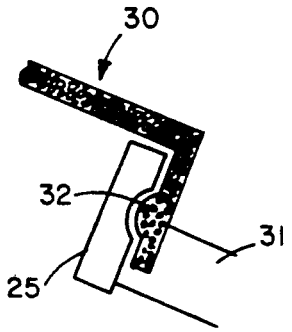
FIG. 4 illustrates a closure section of a lid used on the container.

The container 10 includes hollow housing 14 which is elliptically shaped and which has a bottom 16 which is located superadjacent to the barrel of the weapon when the housing is mounted for use on that weapon. The housing also includes a top unit 18 and a sidewall 20 connecting the top unit to the bottom, with the top unit including a lip 21 which slidably receives the sidewall to frictionally hold the top unit to the sidewall. The housing can be opened by removing the top unit from the sidewall. Since the housing is elliptical, it includes a major axis MA extending from the top unit to the bottom. In the preferred embodiment, the sidewall is elliptical in shape and includes a plurality of rectangular viewing ports 22 defined through the wall at locations which are spaced apart along the major axis of the housing and which are oriented to have the width dimension of the ports oriented parallel to the top and bottom of the housing. The contents of the housing can be viewed through the ports 22 to determine how much ammunition is left. The wall is oriented vertically in the in-use condition, and a projectile loading port unit 24 is located on the housing top 18. The projectile loading port unit includes a cylindrical tubular body 25 attached at one end thereof to the top unit 18 and having an open top spaced from the top unit 18. The loading port unit is skewed with respect to the housing. A discharge port unit 26 located on the housing bottom 16, and includes a tubular body 27 attached at one end thereof to the housing bottom 16. The discharge port unit is oriented to be essentially parallel to the major axis of the housing. The loading port unit and the discharge port unit are tubular in configuration and connect to the inside volume of the hollow housing. The loading and discharge port units are spaced apart from each other along the major axis of the elliptical housing, and as shown in FIGS. 3 and 4, a lid element 30 is hingeably connected to the loading port by a hinge H. The lid element 30 is adapted to move between a loading port uncovering position in which paint ball projectiles can be inserted into the housing, and a loading port covering position which closes that loading port. The lid element 30 also includes a lip 31 which engages a dimple 32 defined in body 25 for holding the lid in a closed condition as shown in FIG. 4.

Figure 5:
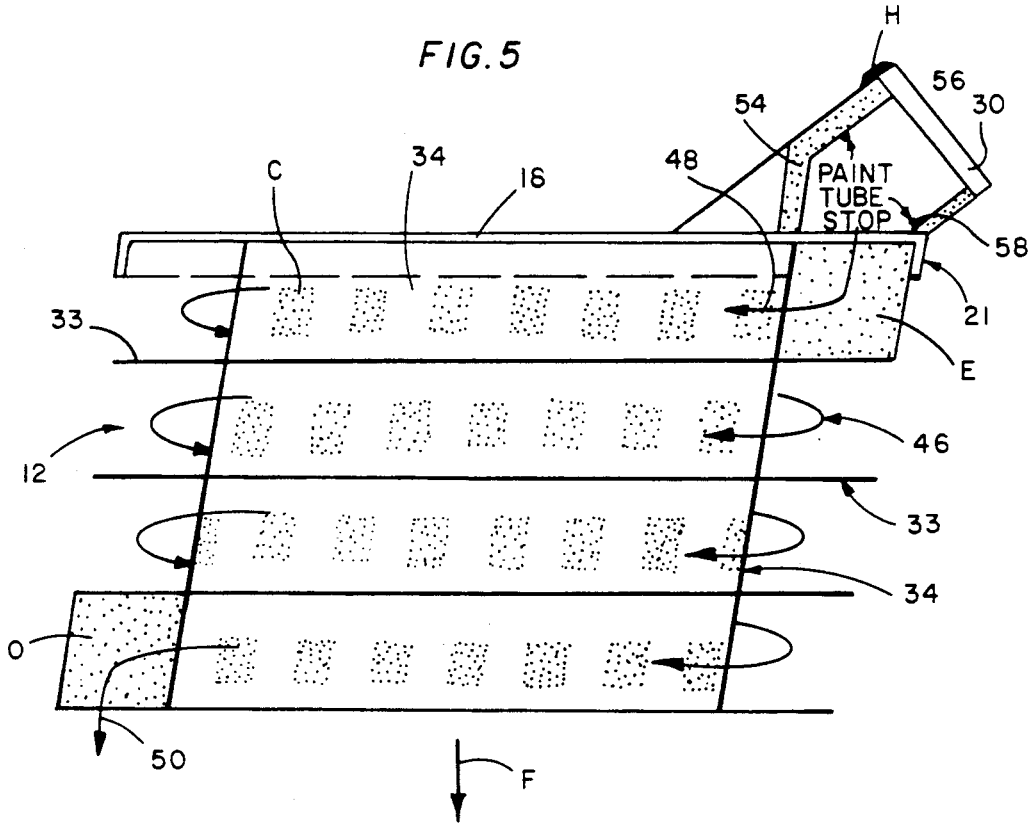
FIG. 5 is an exploded side elevational view showing the helical ramp element and the housing element of the container of the present invention.
Figure 5:
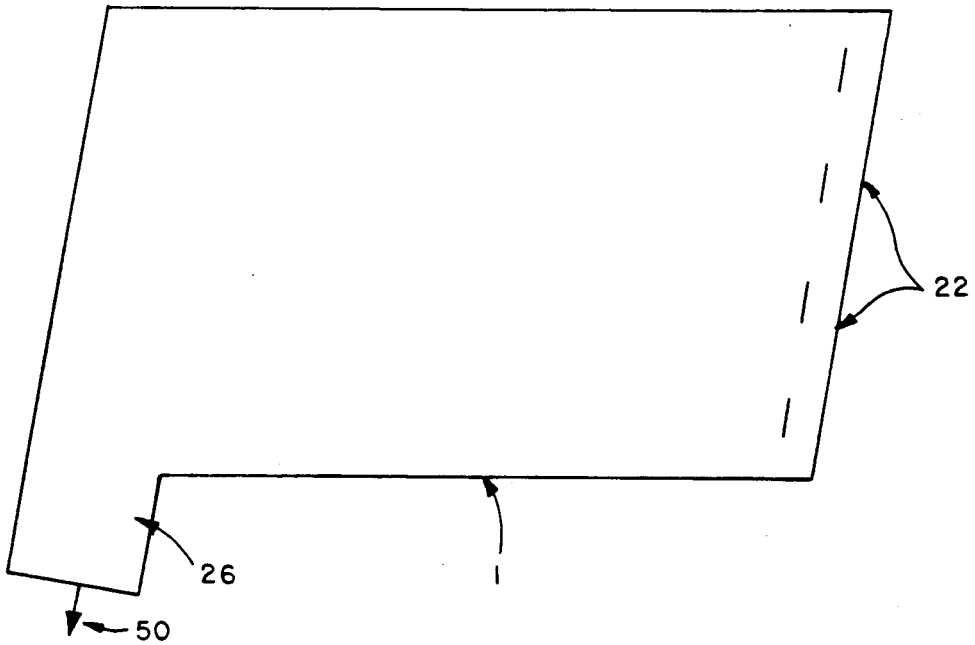

As shown in FIG. 5, the ramp section includes a helical ramp 33 which is spirally wound around a central body 34, and the ramp section includes an entrance section E located adjacent to the feed port 24 to receive paintballs therefrom, and an outlet section 0 located adjacent to the outlet port 26. The ramp section also includes a plurality of paintball movement direction control elements C mounted on the central body 34 to ensure that the paintballs move only in one direction from the entrance section toward the outlet section during operation of the container. The ramp 33 and the central body 34 are both elliptical in peripheral shape to match the elliptical shape of the housing and each has a major axis extending in a direction to be coincident with the major axis of the housing when the ramp is positioned in the housing. The ramp is moved into the housing in direction F as indicated in FIG. 5.

Figure 6:
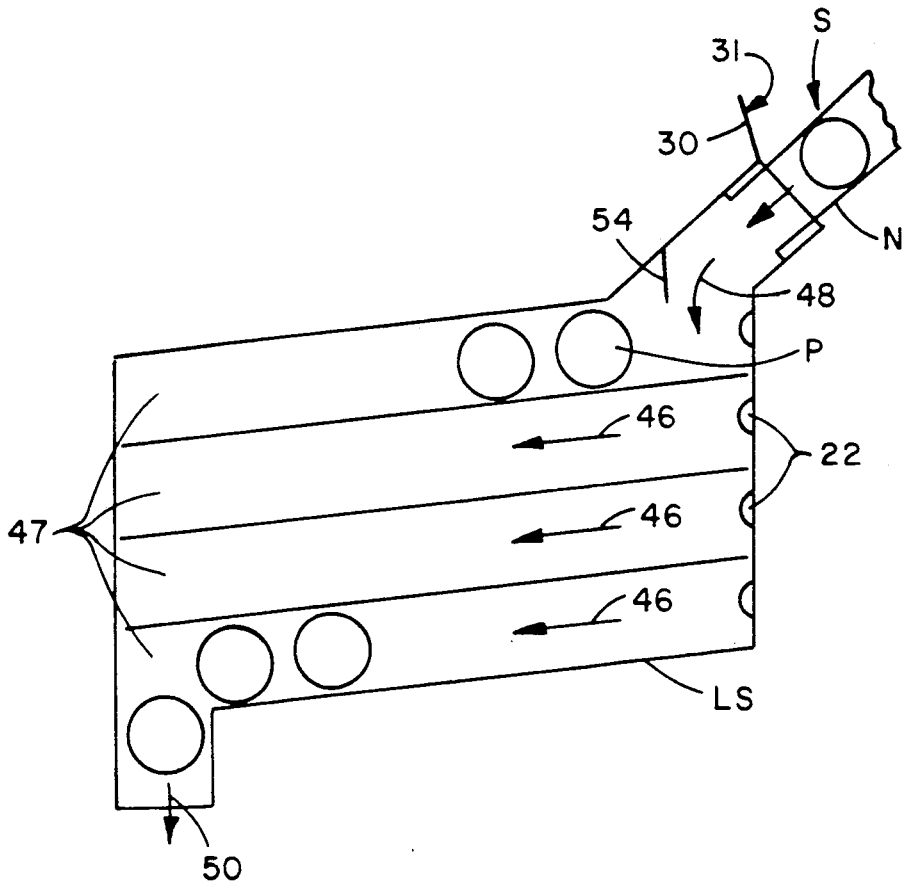
FIG. 6 is a cutaway side elevational view of the container in conjunction with a device for loading the container with paintballs.

As illustrated in FIGS. 5 and 6, paint balls projectiles P move from a source S of paintballs into a helical path as defined by the helical ramp 33, the inner surface of the housing 14 and the central body 34 via the inlet section 0 in the direction indicated in FIG. 6 by the arrows 46, and move through the helical path 47 under the influence of gravity to be discharged into the weapon firing chamber via the discharge port element 26 as indicated in FIG. 6 by the arrows 46, 48 and 50.

As shown in FIGS. 5 and 6, the inlet section includes a guide element 54 against which paintballs from the loading source S engage to be guided into the entrance section 0 of the helical path 47. Stop elements 56 and 58 are also mounted on the inlet port 24 to limit the extent to which a paintball source discharge tube N can be inserted into the port 24. This ensures proper movement of the paintballs during a loading process. The paintballs are forced to move downward before contacting the ramp 33 to prevent jamming at the inlet port. Thus, arrow 48 is shown to be right-angled.

Figure 7:
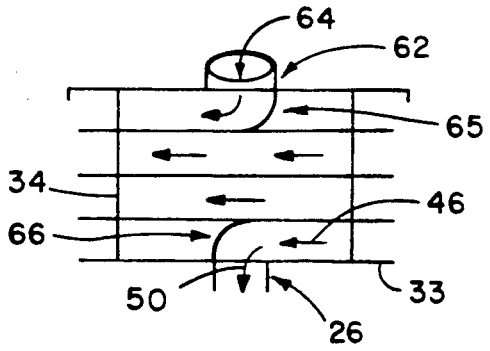
FIG. 7 illustrates a modification of the container which includes a loading port located essentially centrally of the top of the container.

An alternative form of the container is indicated in FIG. 7 as including a housing loading port 62 which is oriented at a skewed angle with respect to the housing top 18, but which is positioned essentially centrally of that top near an intersection of a major and a minor axes of the top. The angled loading port unit 62 also includes a lid 64. A curved guide means 65 guides paintballs onto the helical ramp. The paintballs move along the helical ramp in the feed direction 46, and contact a sloped outlet guide means 66 to be guided into the discharge port unit 26 as indicated by arrow 50.

Still further, if the weapon is to be used on an incline, as by aiming uphill or downhill, the helical ramp can be modified to include a lowermost section LS (see FIG. 6)

that is oriented at a skewed angle to the remaining sections and with respect to the housing major axis.

Figure 8:
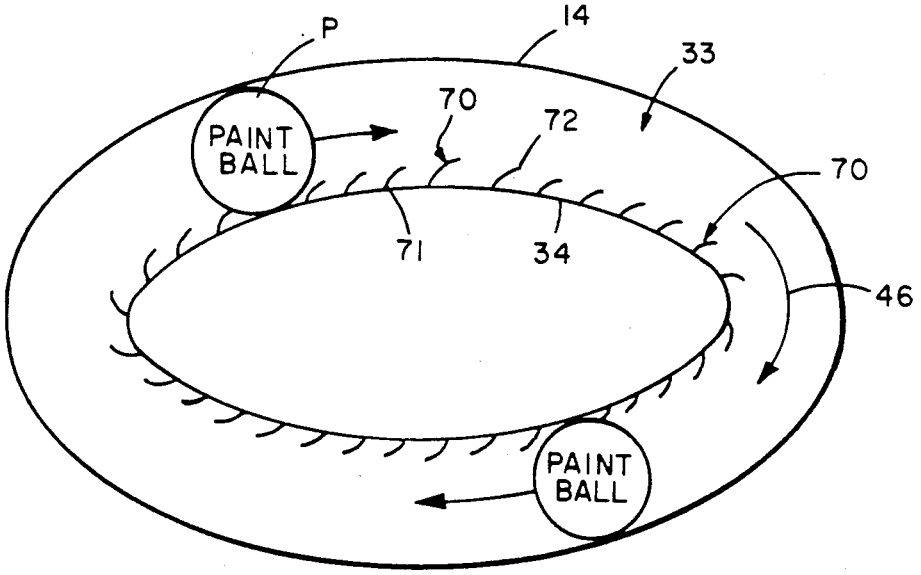
FIG. 8 is a perspective view of a ramp section having one-way elements on the container housing.

As shown in FIGS. 5, 8, 9 and 10, the device includes a projectile movement control means C. One form of the projectile movement control means C is shown in FIG. 8, and includes a plurality of arcuate flexible elements 70 which are each mounted at a proximal end 71 on the central body 34 and extend over the ramp to a distal end 72. These elements 70 are curved to be convex when viewed from the entrance section E looking in the feed direction 46 so the paintballs P can move past each element 70 when that paintball is moving in the forward feed direction 46, but will be prevented from moving in a rearward direction opposite to the direction 46 by the elements 70. Such action is indicated in FIG. 8. The elements are concave when viewed in this reverse direction, and are stiff enough to prevent the paintballs from moving in such rearward direction.

Figure 9:
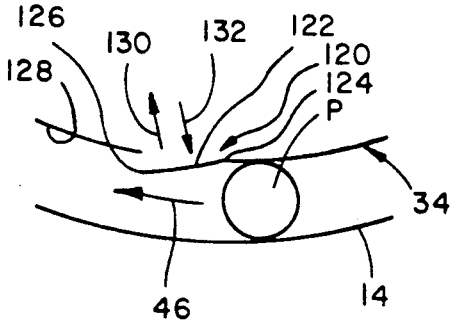
FIG. 9 is a from of the one-way elements used to prevent the paintballs from moving back towards the feed port of the container.

Another form of the movement control means C is shown in FIG. 9 and includes ramp 122 that is attached at one end 124 thereof to the central body 33 adjacent to the ramp, and is biased to extend inwardly of the helical path 47 to have another end 126 thereof spaced from the housing inner surface and from the central body surface 128. The ramp 122 is formed of flexible metal material that has a material memory and thus will move back into the FIG. 9 orientation after being moved out of such orientation. Thus, when a paintball P moves in the feed direction 46 past the ramp 122 towards the outlet section of the helical ramp the ramp 122 is moved outwardly as indicated in FIG. 9 by the arrow 130. However, after the paintball has moved past the ramp 122, the resiliency of the ramp 122 moves it back in the direction 132 to the FIG. 9 orientation. The paintball is thus prevented from moving in the direction opposite to the direction indicated by arrow 46. The ramps are placed at various locations along the helical path so that the paintballs will not rattle about and will be held in position by the ramps.

Figure 10:
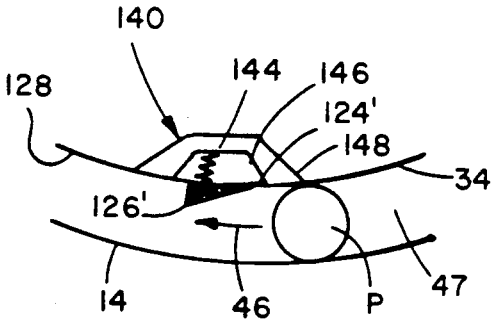
FIG. 10 is another form of the one-way elements used to prevent the paintballs from moving back towards the feed port of the container.

Another form of the projectile moment controlling means C is shown in FIG. 10 as including a spring-biased element 140 which includes a ramp 122' attached at one end 124' thereof to the central body 34 and having the other end 126' thereof spaced from the inner surface 128 of the housing. The ramp 122' is triangular in shape and has a spring 144 mounted at one end thereof on a spring mount 146 affixed to the coil and having the other end thereof engaged with the ramp 122' to force that ramp 122' in direction 132. A housing 148 encases the spring mount. The ramp 122' moves in direction 130 when the paintball P moves therepast, and then returns to the FIG. 10 orientation in direction 132 after the paintball passes the ramp 122'. Several ramps 122' can be included, and the paintballs are thus held in position and kept moving in the direction towards the outlet section 26 and prevented from moving in a reverse direction towards the inlet section 24 of the helical path.

It is understood that while certain forms of the present invention have been illustrated and described herein, it is not to be limited to the specific forms or arrangements of parts described and shown.

I claim

1. A projectile container comprising:

A) a hollow housing including (1) means for mounting said hollow housing on top of a device which selectively discharges fragile projectiles, such as paintballs, under the influence of a source of fluid pressure, (2) a bottom located adjacent to the device when the housing is mounted on top of the device, (3) a top unit, (4) a side wall connecting said housing bottom to said housing top unit, (5) a plurality of viewing ports defined through said housing side wall, (6) a loading port unit located on said housing top, and (7) a discharge port unit located on said bottom in position to communicate with a firing chamber of the device;

B) a projectile storage element located inside said hollow housing and including (1) an inlet section, (2) an outlet section, (3) a monolithic, on-piece helical ramp connecting said projectile storage element inlet section to said projectile storage element discharge section, said helical ramp (a) defining a continuous helical path extending around a central axis which is vertically oriented when the housing containing said helical ramp is mounted on the device, and (b) said helical ramp being sized to slidingly accommodate a multiplicity of projectiles thereon so that said projectiles move from said inlet section towards said outlet section under the influence of gravity, (4) a projectile movement control means which controls the movement of projectiles located in sid helical path during projectile movement towards said projectile storage element inlet section for preventing such projectiles from rattling or jamming during such movement, said projectile movement control means including a multiplicity of flexible, arcuate elements extending above said ramp and biased inwardly of said helical path, each flexible element extending in parallel relation to a plane containing a ramp section immediately adjacent to said each arcuate element, each arcuate element being curved to be convex with respect to a direction of projectile movement from said inlet section towards said outlet section.

2. The projectile container defined in claim 1 wherein said helical ramp is sloped at a skewed angle with respect to said projectile storage element outlet section adjacent to said projectile storage element outlet section.

3. The projectile container defined in claim 2 wherein said lid further includes a locking projection and said housing loading port unit further includes a dimple which receives said locking projection when said lid covers said housing loading port unit.

4. The projectile container defined in claim 3 further including a central body to which said helical ramp is attached.

5. The projectile container defined in claim 4 wherein said housing loading port unit is oriented at a skewed angle with respect to said housing top unit.

6. The projectile container defined in claim 4 wherein said housing discharge port unit is located near a center position on said housing bottom.

7. The projectile container defined in claim 6 wherein said housing loading port unit is located near a center position on said housing top unit.

8. The projectile container defined in claim 4 wherein said housing is elliptical in shape.

9. The projectile container defined in claim 4 wherein said helical ramp is elliptical in peripheral shape.

10. The projectile container defined in claim 9 wherein said top unit includes a lip which slidably engages said housing sidewall.

11. A projectile container comprising:

A) a hollow housing including (1) means for mounting said hollow housing on top of a device which selectively discharges fragile projectiles, such as paintballs, under the influence of a source of fluid pressure, (2) a bottom located adjacent to the device when the housing is mounted on top of the device, (3) a top unit, (4) a side wall connecting said housing bottom to said housing top unit, (5) a plurality of viewing ports defined through said housing side wall, (6) a loading port unit located on said housing top, and (7) a discharge port unit located on said bottom in position to communicate with a firing chamber of the device;

B) a projectile storage element located inside said hollow housing and including (1) an inlet section, (2) an outlet section, (3) a central body, (4) a monolithic, one-piece helical ramp attached to said projectile storage element central body connecting said projectile storage element inlet section to said projectile storage element discharge section, said helical ramp (a) defining a continuous helical path extending around a central axis which is vertically oriented when the housing containing said helical ramp is mounted on the device, and (b) said helical ramp being sized to slidingly accommodate a multiplicity of projectiles thereon so that said projectiles move from said inlet section towards said outlet section under the influence of gravity, (4) a projectile movement control means which controls the movement of projectiles located in said helical path during projectile movement towards said projectile storage element inlet section for preventing such projectiles from rattling or jamming during such movement, said projectile movement control means including (a) a hinge connected to said central body, and (b) a ramp connected to said hinge and biased inwardly of said helical path to move between a by-pass position which is flush with an inner surface of said central body to a blocking position raised from said central body inner surface inwardly of said helical path.

12. The projectile container defined in claim 11 wherein said projectile movement control means further includes a spring element having one end connected to said central body and another end contacting said movement control means ramp and biasing said movement control means ramp towards said blocking position.

* * * * *